US005334047A

United States Patent [19]

Lutsky

[11] Patent Number: 5,334,047

[45] Date of Patent: Aug. 2, 1994

[54] ELECTRICAL CONNECTOR MOUNTING POSTS

[75] Inventor: Arthur A. Lutsky, Irvine, Calif.

[73] Assignee: Thomas & Betts Corporation, Memphis, Tenn.

[21] Appl. No.: 30,528

[22] Filed: Mar. 12, 1993

[51] Int. Cl.[5] ..... H01R 13/74

[52] U.S. Cl. ..... 439/544; 439/572

[58] Field of Search ..... 439/544, 559, 572, 82

[56] References Cited

U.S. PATENT DOCUMENTS

| | | | |
|---|---|---|---|
| 890,770 | 6/1908 | Hubbell . | |
| 2,976,345 | 3/1961 | Whitted | 174/153 |
| 3,582,867 | 6/1971 | Thompson et al. | 339/92 |
| 3,688,635 | 9/1972 | Fegen | 85/5 |
| 3,731,261 | 5/1973 | Spadoni, Jr. | 339/220 |
| 4,368,942 | 1/1983 | Mathe et al. | 339/186 |
| 4,691,971 | 9/1987 | Hahn | 439/78 |
| 4,969,259 | 11/1990 | Macek et al. | 439/82 X |
| 5,122,075 | 6/1992 | Kile | 439/554 X |

FOREIGN PATENT DOCUMENTS 33286 8/1981 European Pat. Off. .

OTHER PUBLICATIONS

IBM Technical Disclosure Bulletin-Printed Circuit Board and Component Keying and Retention Design (vol. 33, No. 4, Sep. 1990) pp. 211-218.

*Primary Examiner*—Eugene F. Desmond

*Attorney, Agent, or Firm*—Robert M. Rodrick

[57] ABSTRACT

An electrical connector includes mounting posts for insertion into through-holes of a printed circuit board. The connector includes a connector housing having an upper connection surface and an lower board mounting surface. A pair of mounting posts extend from the lower mounting surface adjacent each end of the connector. Each of the mounting posts is insertable into a through-hole in the printed circuit for frictional engagement with the walls of the through-hole. The mounting posts include curved portions for engagement with the walls of the through-holes. The curved portions of the mounting posts have a radius of curvature which is substantially less than the radius of curvature of the through-holes to compensate for variations in tolerances as between the mounting post and the through-holes.

8 Claims, 2 Drawing Sheets

ELECTRICAL CONNECTOR MOUNTING POSTS

FIELD OF THE INVENTION

The present invention relates generally to an electrical connector for mounting to a printed circuit board or similar substrate. More particularly, the present invention relates to connector mounting posts which are insertable into holes in the printed circuit board to support the electrical connector thereon.

BACKGROUND OF THE INVENTION

It has been long known to use mounting posts which extend from an electrical connector to support the connector on a printed circuit board or other substrate to which the electrical connector is to be attached. These mounting posts are insertable into through-holes of the printed circuit board and locate and secure the connector to the printed circuit board prior to permanent connection such as by soldering the electrical contacts of the connector to the printed circuit board.

As may be appreciated, the relative positioning of the mounting posts with respect to the through-holes of the printed circuit board is critical in achieving a secure fit between the connector and the printed circuit board. Variations as between the diameter of the through-hole and the diameter of the mounting post could render insertion of the mounting post in the through-hole difficult. The distance between through-holes of the printed circuit board, as it relates to the distance between the mounting posts, is also critical in assuring proper positioning of the connector with respect to the printed circuit board. Even slight variations between the spacing of the through-holes of the printed circuit board and the spacing of the mounting posts could cause significant interference between the posts and the through-holes so as to render insertion difficult.

In addition, engagement of the mounting posts with the through-holes of the printed circuit board is designed to be a frictional fit so that the connector is temporarily secured to the printed circuit board prior to soldering the connector contacts to the board. This again adds a further complication which renders proper positioning of the posts with respect to the through-holes difficult.

It is, therefore, desirable to provide an electrical connector having mounting posts which facilitate the easy mounting of an electrical connector to a printed circuit board.

SUMMARY OF THE INVENTION

It is an object of the present invention to provide an electrical connector having mounting posts which permit the connector to be easily supported over through-holes of a printed circuit board.

It is a further object of the present invention to provide connector mounting posts which will accommodate variations in through-hole size and relative spacing.

It is a still further object of the present invention to provide mounting posts for an electrical connector which will securely support the electrical connector on the printed circuit board prior to soldering.

In the efficient attainment of these and other objects, the present invention provides an electrical connector for mounting to a printed circuit board. The circuit board has spaced apart substantially circular openings having a given radius of curvature. The electrical connector includes an elongate connector housing having an upper connection surface and a lower board mounting surface. The electrical connector includes mounting posts extending from the lower mounting surface. Each of the mounting posts is insertable into an opening in the printed circuit board for frictional engagement with the walls of the opening. Each of the mounting posts includes curved portions for engagement with the walls of the openings, the curved portions of the post have a radius of curvature which is less than the radius of curvature of the opening.

As particularly described by way of preferred embodiment herein, the mounting posts of the electrical connector have generally a diamond-like cross-sectional shape, defining a major and a minor axis. The major axis of one mounting post of the electrical connector extends perpendicularly to the major axis of the other mounting post of the electrical connector.

DETAILED DESCRIPTION OF THE PREFERRED EMBODIMENTS

Figure 1:
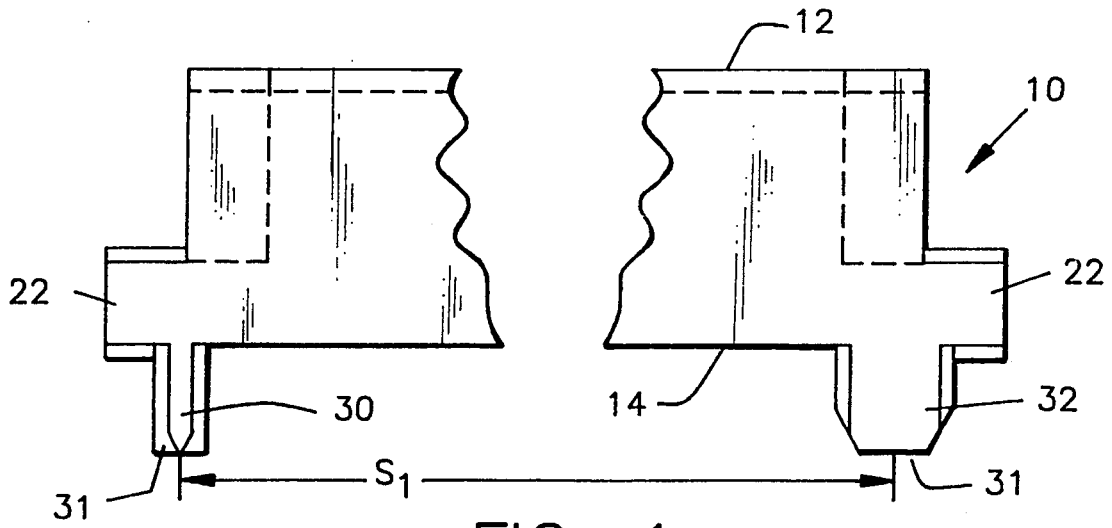
FIGS. 1 and 2 show in a front-plan and bottom views respectively, an electrical connector of the present invention with the central portion broken away.
Figure 2:
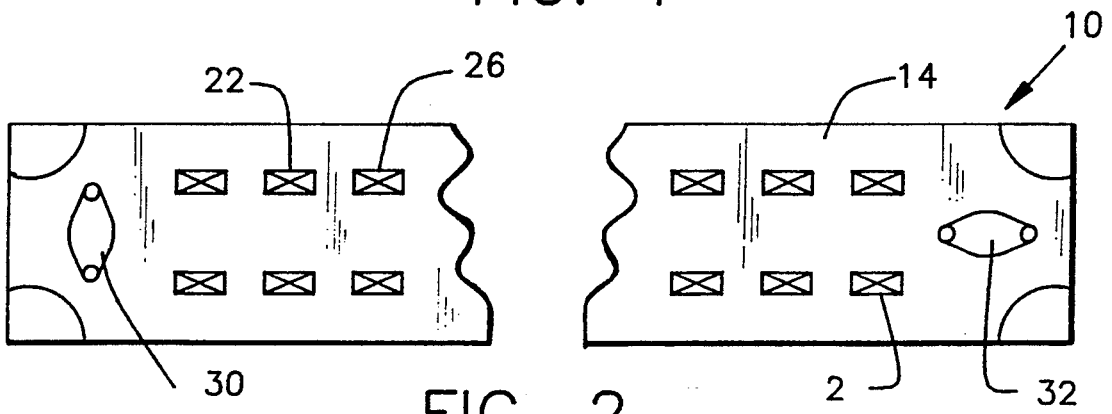
Figure 3:
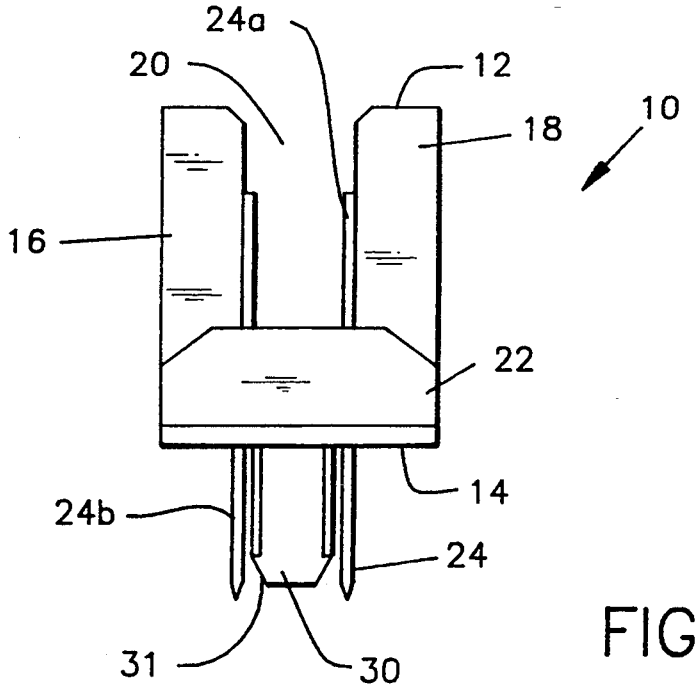
FIG. 3 is a side-elevational showing of the electrical connector of FIGS. 1 and 2.

Referring now to FIGS. 1–3, an electrical connector 10 of the present invention is shown. Electrical connector 10 is an elongate rectangular member formed of suitably electrically insulative plastic. Connector 10 includes an upper connection surface 12 for receipt of a mating electrical connector (not shown) and an opposed lower surface 14, which is supported or mounted on a printed circuit board to which the connector is secured in a manner which will be described in further detail hereinbelow.

Connector 10 is of conventional construction having a pair of longitudinal opposed sidewalls 16 and 18 defining therebetween a cavity 20, which accommodates therein the mating electrical connector. Each opposed end of electrical connector 10 includes an extending mounting ear 22 which may support appropriate hardware to secure the connector to the printed circuit board as is well-known in the connector art.

Electrical connector 10 supports a plurality of electrical contacts 24 therein (FIG. 2). In the present illustrative embodiment, contacts 24 are pin-type contacts which extend through openings 26 in the lower surface 14 of connector 10. While pin-type contacts 24 are shown, it may be appreciated that a variety of contacts, including socket-type contacts, may be employed with the present invention. Typically, contacts 24 are elongate having upper portions 24*a*, which extend into cavity 20 for electrical engagement with contacts of the mating electrical connector. Contacts 24 also include opposed ends 24b, which extend below lower surface 14 for electrical engagement with traces on the printed circuit board as is conventional in the electrical connector art.

Figure 7:
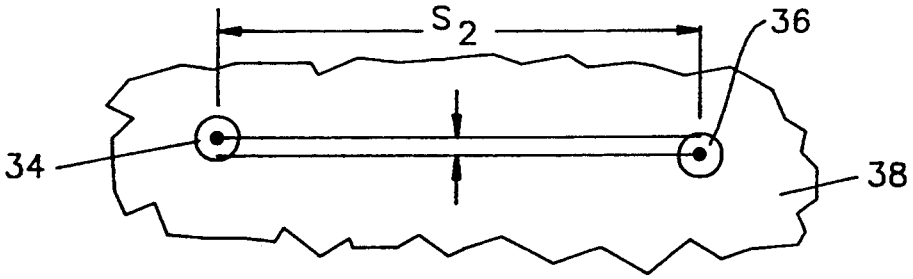
FIG. 7 shows through-holes of a printed circuit board into which the mounting posts of the connector of FIG. 1 may be inserted.

Electrical connector 10 further includes a pair of mounting posts 30 and 32, which extend from the lower surface 14 of connector 10. Mounting posts 30 and 32 extend adjacent each end of connector 10 beneath mounting ears 22. Mounting posts 30 and 32 are constructed to be inserted into through-holes 34 and 36 of the printed circuit board 38 (FIG. 7). The lower ends 31 of mounting posts 30 and 32 are tapered to facilitate entry into through-holes 34 and 36 respectively.

As shown in FIGS. 1–3, mounting posts 30 and 32 are generally diamond-like in shape, defining a major axis and minor axis transverse thereto. Mounting post 30 is rotated 90° with respect to the position of mounting post 32 so that the respective major and minor axes of the mounting posts are perpendicular to one another. Opposed ends of the major axis define curved apexes 44 for engagement with through holes 34 and 36 of the printed circuit board 38 as will be further described hereinbelow. The opposed ends of the minor axis are constructed for non-engagement with the walls of through-holes 34 and 36. While the present invention shows posts having a pair of curved opposed ends defining the diamond-like shape, other shapes and number of curved portions may also be employed.

Referring to FIGS. 4–7, the engagement of mounting posts 30 and 32 with through-holes 34 and 36 of printed circuit board 38 is described.

Figure 4:
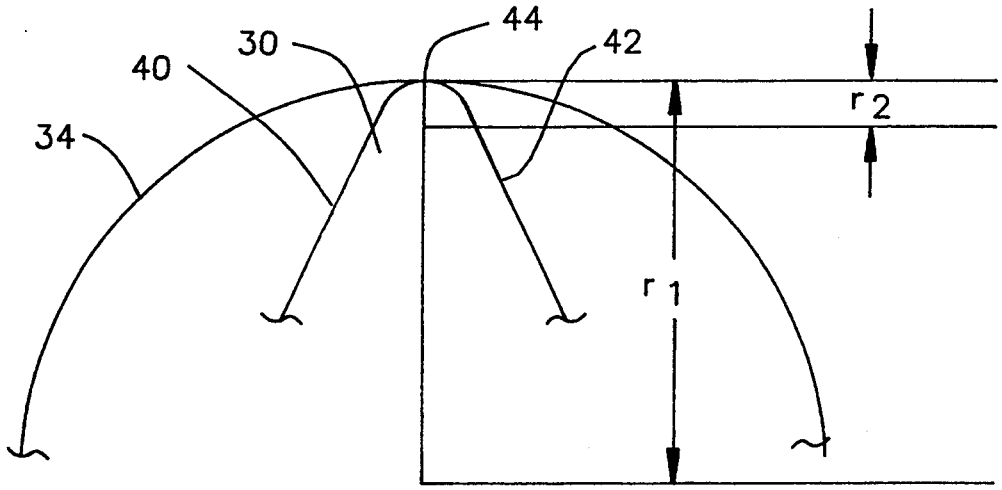
FIG. 4 is a greatly enlarged schematic representation of the relationship between the mounting post of the connector of FIG. 1 and a through-hole of a printed circuit board.

FIG. 4 shows, in greatly enlarged schematic fashion, the relationship between the walls of through-hole 34 and mounting post 30, which is inserted thereinto. Through-hole 34 is a substantially circular opening having a radius $r_1$ which defines a given radius of curvature of opening 34. Post 30, more particularly shown in FIGS. 5 and 6, has an elongated shape having opposed sets of inwardly converging sidewalls 40 and 42 at each end thereof. Each set of sidewalls 40 and 42 converge at curved apex 44, which is constructed for engagement with the wall defining through-hole 34. Curved apex 44 is defined by a radius $r_2$, which is substantially less than radius $r_1$ of through-hole 34. Thus, the radius of curvature of apex 44 is substantially less than the radius of curvature of through-hole 34. As the radius of curvature is the inverse of the curvature of a surface, the curvature of apex 44 is substantially greater than the curvature of through-hole 34. The actual surface contact between apex 44 and walls of through-hole 34 is minimized by the respective curvatures so as to provide minimal interference between apex 44 of mounting post 30 and the wall of through-hole 34. As will be shown with respect to FIGS. 5 and 6, the particular construction of mounting post 30 permits the accommodation of greater dimensional tolerance as between the size and location of mounting posts 30 and 32 and through-holes 34 and 36.

Figure 5:
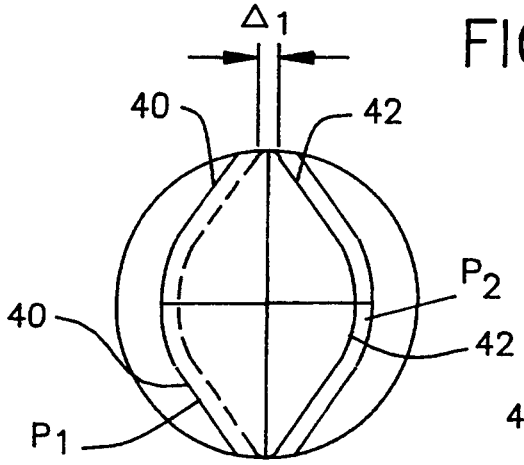
FIGS. 5 and 6 respectively, show engagement of the mounting post of FIG. 1 with relatively differently sized and positioned through-holes.

First, the spacing of the through-holes 34 and 36 with respect to mounting posts 30 and 32 may not be identical. Distance $s_1$ between the centers of mounting posts 30 and 32, as shown in FIG. 1, may be slightly greater or less than the distance $s_2$ between the centers of through-holes 34 and 36 (FIG. 7). Such misalignment, shown in FIG. 5, may be a distance $\Delta_1$. In such a situation, the position $p_1$ of mounting post 30 with respect to through-hole 34 is shifted to that of $p_2$, with the major axis of post 30 shifted to the right as shown in FIG. 5 a distance $\Delta_1$. Since the radius of curvature of apex 44 (FIG. 4) at each end of the major axis is substantially less than the radius of curvature of the wall of through-hole 34 and, therefore, the curvature of each apex 44 is substantially greater than the curvature of through-hole 34, interference between apex 44 and the wall of through-hole 34 is minimal notwithstanding the relative positional shift of post 30 with respect to through-hole 34 from position $p_1$ to position $p_2$. Thus, even a relatively significant offset as between post 30 and through-hole 34 will result in only a minimal increase in interference between each apex 44 and the wall of through-hole 34. This permits mounting posts to be more tolerant of variances as between distance $s_1$ of posts 30 and 32 and distance $s_2$ of through-holes 34 and 36.

Figure 6:
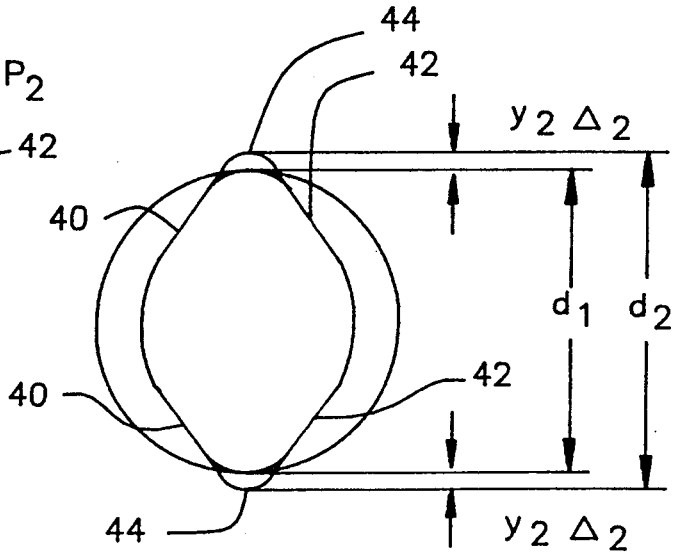

Additionally, as shown in FIG. 6, the present invention compensates for dimensional variation as between relative diameter $d_1$ of through-hole 34 and the length of major axis $d_2$ of mounting post 30. In certain situations, mounting post 30 may have a major axis $d_2$, which is slightly greater than the diameter $d_1$ of through-hole 34. As both sets of tapered sidewalls 40 and 42 merge to form a curved apex 44 at each end of the major axis, a minimal increase in the interference as between the wall of through-hole 34 and each curved apex 44 will occur.

The walls 40 and 42 taper sharply inwardly toward apex 44. Further, as described above with respect to FIG. 4, the curvature of apex 44 is substantially greater than the curvature of through-hole 34. Thus, minimum interference occurs therebetween even in situations where $d_2$ exceeds $d_1$ as shown in FIG. 6. Ideally, mounting post 30 is designed to have a major axis length $d_1$ which is identical to the diameter of through-hole 34, $d_2$ i.e. $d_1=d_2$. However, manufacturing tolerance may cause the major axis $d_2$ of post 30 to exceed the through-hole diameter $d_1$ a slight distance $d_2-d_1=\Delta_2$. As the mounting post 30 is self-centering in through-hole 34, one-half of such interference ($\frac{1}{2}\Delta$) will be borne by each opposed apex 44. This interference is relatively minimal and will not significantly increase the difficulty in insertion post 30 into through-hole 34.

Still further the present invention provides for accommodating misalignment as between the transverse positioning of the centers of through-holes 34 and 36. As shown in FIG. 7, during the manufacture of printed circuit board 38 it is possible that centers of through-holes 34 and 36 may be transversely offset a distance a. Referring to FIG. 2, mounting posts 30 and 32 are arranged so that one mounting post 32 has its major axis aligned with the longitudinal direction of connector 10 while the other mounting post 30 has its major axis aligned perpendicularly thereto. In a manner similar to that shown with respect to FIG. 5, the transverse offset of through-holes 34 and 36 may be compensated for by the particularly shown construction and arrangement of mounting posts 30 and 32.

The present invention, therefore, compensates for dimensional tolerances between mounting post 30 and 32 and through holes 34 and 36 in three respects. First, the construction of posts 30 and 32 compensates for variances between the spacing of through-holes 34 and 36 ($s_2$) and the spacing of posts 30 and 32 ($s_1$). Second, the post construction compensates for variances between the through-hole size ($d_1$) and the size of post 30 ($d_2$). Third, the arrangement of posts 30 and 32 compensates for transverse misalignment of through-holes 34 and 36 (*a*).

Various changes to the foregoing described and shown structures would now be evident to those skilled in the art. Accordingly, the particularly disclosed scope of the invention is set forth in the following claims.

I claim:

1. An electrical connector for mounting to a printed circuit board having spaced apart substantially circular openings having a given radius of curvature, said connector comprising:

an elongated connector housing having first and second connector ends, an upper connection surface and an opposed lower board mounting surface;

a first mounting post extending from said lower mounting surface adjacent said first connector end; and a second mounting post extending from said lower mounting surface adjacent said second connector end;

each of said first and second mounting posts being insertable into a respective said opening in said board for frictional engagement with the walls of said opening;

each of said first and second mounting posts including a cross-section having a major axis and a minor axis, said first mounting post major axis extending perpendicularly to said major axis of said second mounting post, each end of said major axis having a curved portion for engagement with said walls of said openings, said curved portions having a radius of curvature which is substantially less than said radius of curvature of said opening.

2. An electrical connector of claim 1 wherein said first and second mounting posts have a diamond-shaped cross-section.

3. An electrical connector of claim 1 wherein said ends of said minor axis are constructed for non-engagement with said walls of said opening.

4. An electrical connector of claim 1 wherein said first and second mounting posts have tapered end portions.

5. An electrical connection assembly comprising:

a printed circuit board having plural circular mounting openings therein, said openings having a given radius of curvature;

an elongate electrical connector supported on the board, said connector having a pair of spaced apart mounting posts, each post positioned in one of said board openings, each of said mounting posts including a cross-section having a major axis and a minor axis, said major axis of one said post extending along the longitudinal extent of said connector and the major axis of said other post extending traversely to said longitudinal extent of said connector, each end of said major axis defining a curved opening engagement surface, each of said surfaces having a radius of curvature which is substantially less than said radius of curvature of said opening.

6. An assembly of claim 5 wherein said opening engagement surfaces, engages diametrically opposite portions of said opening.

7. An assembly of claim 6 wherein each said post has a diamond-shaped cross-section and said curved portions being at opposite ends of the major axis of said diamond.

8. An assembly of claim 7 wherein said connector is elongate having one of said mounting posts adjacent each end thereof.

* * * * *